US008398455B2

(12) United States Patent
Schmitz

(10) Patent No.: US 8,398,455 B2
(45) Date of Patent: Mar. 19, 2013

(54) METHOD OF AND APPARATUS FOR GRINDING CAMS OF A CAMSHAFT

(75) Inventor: Roland Schmitz, Vaihingen (DE)

(73) Assignee: EMAG Holding GmbH, Salach (DE)

( * ) Notice: Subject to any disclaimer, the term of this patent is extended or adjusted under 35 U.S.C. 154(b) by 382 days.

(21) Appl. No.: 12/665,720

(22) PCT Filed: Apr. 12, 2008

(86) PCT No.: PCT/DE2008/000542

§ 371 (c)(1),
(2), (4) Date: Dec. 20, 2009

(87) PCT Pub. No.: WO2008/151586

PCT Pub. Date: Dec. 18, 2008

(65) Prior Publication Data

US 2010/0233939 A1 Sep. 16, 2010

(30) Foreign Application Priority Data

Jun. 13, 2007 (DE) ..... 10 2007 027 832

(51) Int. Cl.
*B24B 19/12* (2006.01)

(52) U.S. Cl. ..... 451/5; 451/49; 451/62

(58) Field of Classification Search ..... 451/62, 451/49, 249, 132, 134, 140, 142, 143
See application file for complete search history.

(56) References Cited

U.S. PATENT DOCUMENTS

| | | | | |
|---|---|---|---|---|
| 1,622,755 | A * | 3/1927 | Asbridge | 451/200 |
| 1,957,568 | A * | 5/1934 | Wills | 451/269 |
| 2,771,716 | A * | 11/1956 | Joyce | 451/246 |
| 2,813,380 | A * | 11/1957 | Narel et al. | 451/249 |
| 4,419,845 | A * | 12/1983 | Voigt et al. | 451/49 |
| 4,443,976 | A | 4/1984 | Kaiser | 51/97 |
| 7,037,173 | B2 * | 5/2006 | Nonoyama et al. | 451/5 |

FOREIGN PATENT DOCUMENTS

| | | |
|---|---|---|
| DE | 102004012385 | 9/2005 |
| JP | 2005052912 | 3/2005 |

* cited by examiner

*Primary Examiner* — Robert Rose
(74) *Attorney, Agent, or Firm* — Andrew Wilford

(57) ABSTRACT

The invention relates to a method and a device for grinding cams of a camshaft (7) in a clamp with two grinding spindles (10, 11), wherein the cams or cam pairs are each arranged in a mirror image relative to the workpiece rotation axis (16), wherein the camshaft (7) is tensioned and rotated about the longitudinal axis thereof. In the device for carrying out the method, the camshaft (7) can be inserted into the workpiece receiver (6) from the side lying opposite the at least one back stay (15) by means of the loading device.

15 Claims, 6 Drawing Sheets

METHOD OF AND APPARATUS FOR GRINDING CAMS OF A CAMSHAFT

CROSS REFERENCE TO RELATED APPLICATIONS

This application is the US-national stage of PCT application PCT/DE2008/000542, filed 12 Apr. 2008, published 18 Dec. 2008 as WO2008/151586, and claiming the priority of German patent application 102007027832.4 itself filed 13 Jun. 2007.

FIELD OF THE INVENTION

The invention concerns a method of and an apparatus for grinding cams of a camshaft.

BACKGROUND OF THE INVENTION

From JP 2005052912, a machine for finish machining of camshafts is known. To simultaneously machine all the cams, a corresponding number of finishers are positioned around the camshaft. As a result, the operating personnel can only access the machine with difficulty. In addition, the camshaft cannot be supported with steady rests, as the space needed for them is occupied by the finishers. Hence the machine is not suitable for grinding at high removal rates. Moreover, for loading and unloading, multi-axial sequences of motion are required because the camshafts have to be moved into the working area or out of the working area lengthwise. EP 0,085225 [U.S. Pat. No. 4,443,976] shows a method of grinding camshafts in which a uniform feed speed is achieved by adapting the speed of rotation of the camshaft to the cam shape. According to this method, the cams are individually machined one after the other.

OBJECT OF THE INVENTION

The object of the invention is to improve the above-described method and machine in such a way that grinding with increased removal rates is possible. Simultaneously, access to the machine is to be improved.

SUMMARY OF THE INVENTION

When grinding cams with high removal rate, uniform feed speed is achieved by adapting the speed of rotation of the camshaft to the cam shape, i.e. while grinding the sections between the cam lobe and the basic circular shape, the rotating speed is slowed down. An advantageous aspect of the invention is that according to this method, camshafts with diametrally opposite cams are machined simultaneously with two grinders. The method is particularly well suited for machining camshafts for four-cylinder combustion engines. These camshafts are provided with four cams or cam pairs located in pairs diametrally opposite each other relative to the longitudinal axis of the camshaft. According to the invention, in a first step the first two cams or cam pairs are machined, the grinders are moved along the longitudinal axis of the camshaft to the still unmachined cams and in a second step the second cams or cam pairs are subjected to the grinding process. As a result of diametrally opposite orientation of the grinders, the loading and unloading can take place from the front operator side and the support of the camshaft by, for example, by steady rests, can be from the back side. Because contrary to what is the case in prior art, only two grinders are used, there is sufficient space available for the holder and the automatic loader. In an advantageous embodiment, two workpiece grabs are provided for the loading and unloading. While the first workpiece grab grips the completely machined camshaft and deposits it on an output conveyor, the second workpiece grab grips an unmachined camshaft from an input conveyor and fits it into the workpiece holder.

BRIEF DESCRIPTION OF THE DRAWING

In the following, the invention is explained in greater detail with the reference to several embodiments.

DETAILED DESCRIPTION

Figure 1:
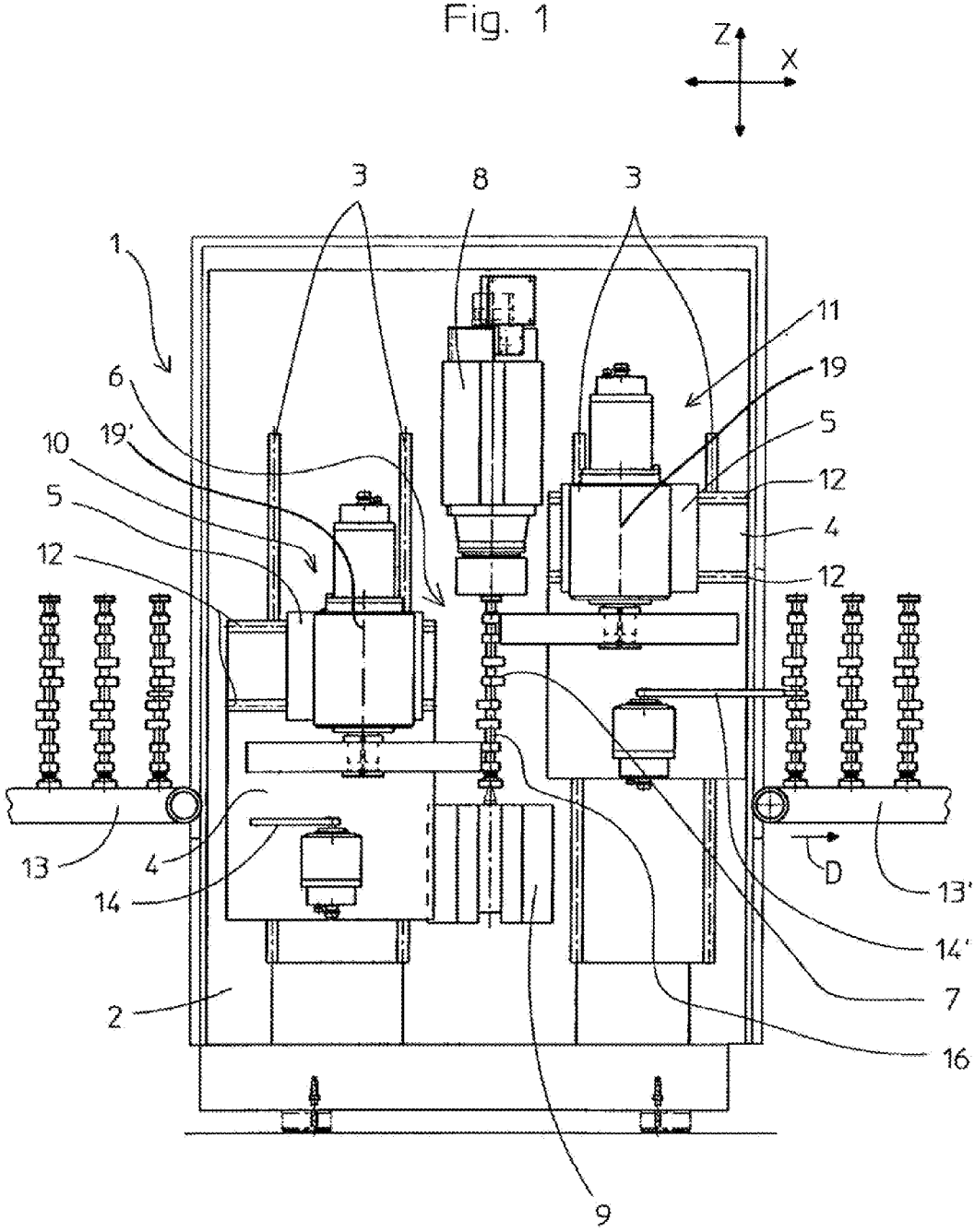
FIG. 1 is a front view of a machining apparatus.

FIG. 1 shows an apparatus 1 for machining camshafts 7, details of the drive, its controller, and the housing not essential to the invention not being shown. The camshafts 7 are chucked in a workpiece holder 6 consisting of a headstock 8 and a tailstock 9 and rotated. Two grinders 10 and 11 diametrally flank the workpiece rotation axis 16. They can each move in two mutually perpendicular directions relative to each other (X and Z axis) on a machine frame 2. To this end, vertical guides 3 are provided on the frame 2 for vertically movable slides 4, and these in turn have respective horizontal guides 12 for horizontally movable carriages 5. The transporting in an out of the camshafts 7 is done by respective conveyors 13 and 13'. Loading and unloading is performed by respective workpiece grabs 14 and 14'.

Figure 2:
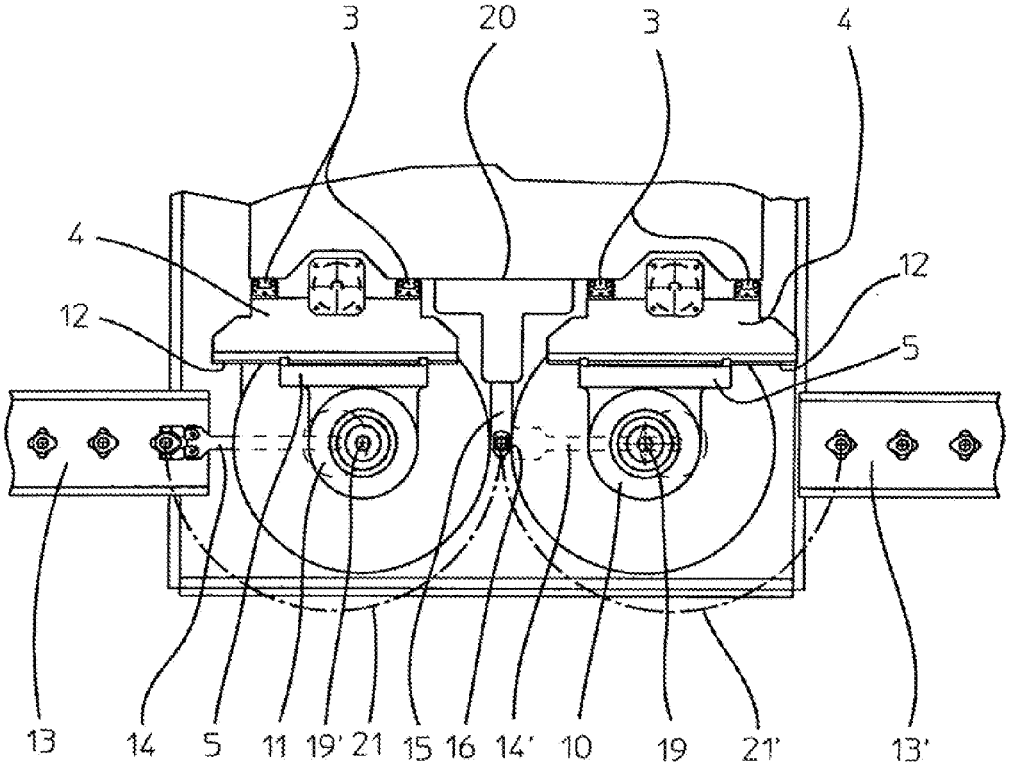
FIG. 2 is a top view partly in cross section of a machining apparatus.

FIG. 2 shows that the workpiece rotation axis 16 and rotation axes 19 and 19' of the grinders 10 and 11 are coplanar. A steady rest 15 is mounted between the vertical guides 3 to support the camshaft 7. In an advantageous embodiment, the guides 3, the workpiece holder 6 and the steady rest 15 are secured to one vertical wall 20 of the frame 2. The unmachined camshafts 7 are fed in by the input conveyor 13, and completely machined camshafts are taken out by the output conveyor 13'. While the workpiece is being changed, the first workpiece grab 14' grips the completely finished camshaft and deposits it on the output conveyor 13'. Simultaneously, the second workpiece grab 14 grips an unmachined camshaft from the input conveyor 13 and places it into the workpiece holder 6. The provision of the grinders 10 and 11 on opposite sides of the workpiece rotation axis 16 and the provision the steady rest 15 between the vertical guides 3 significantly improves accessibility. Moreover, the camshafts 7 can be inserted into the workpiece holder 6 by pivoting them in circular arcs on the operator side.

Figure 3:
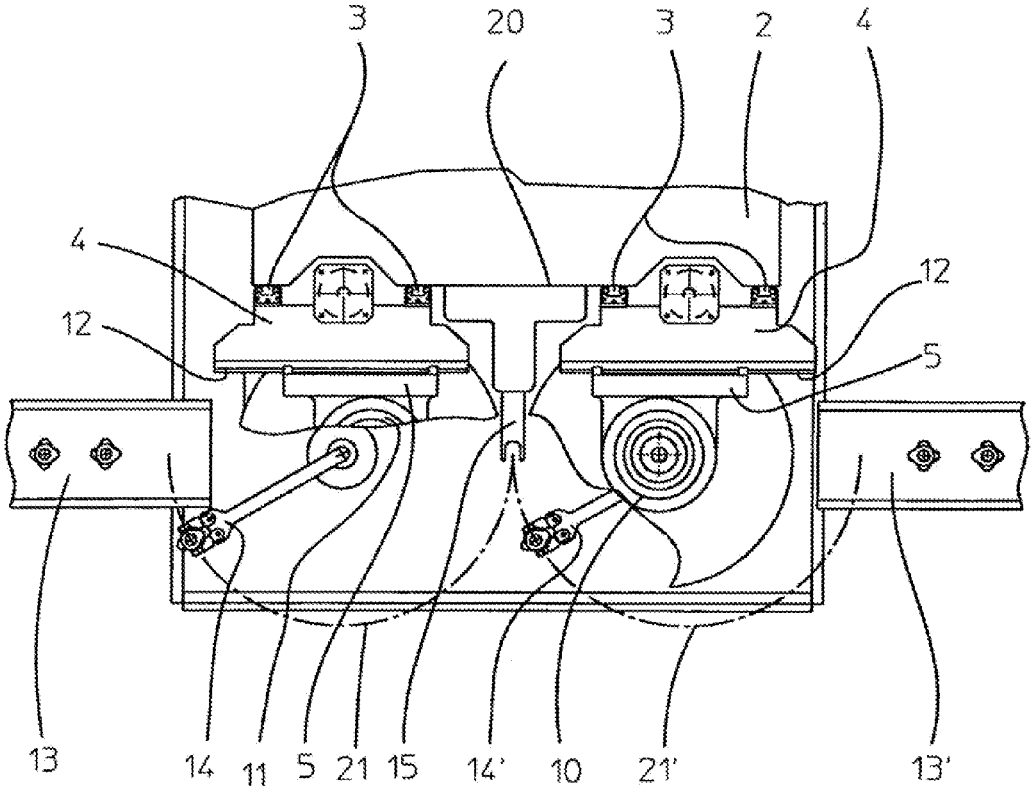
FIGS. 3 and 4 show, together with FIG. 2, the three steps of loading.
Figure 4:
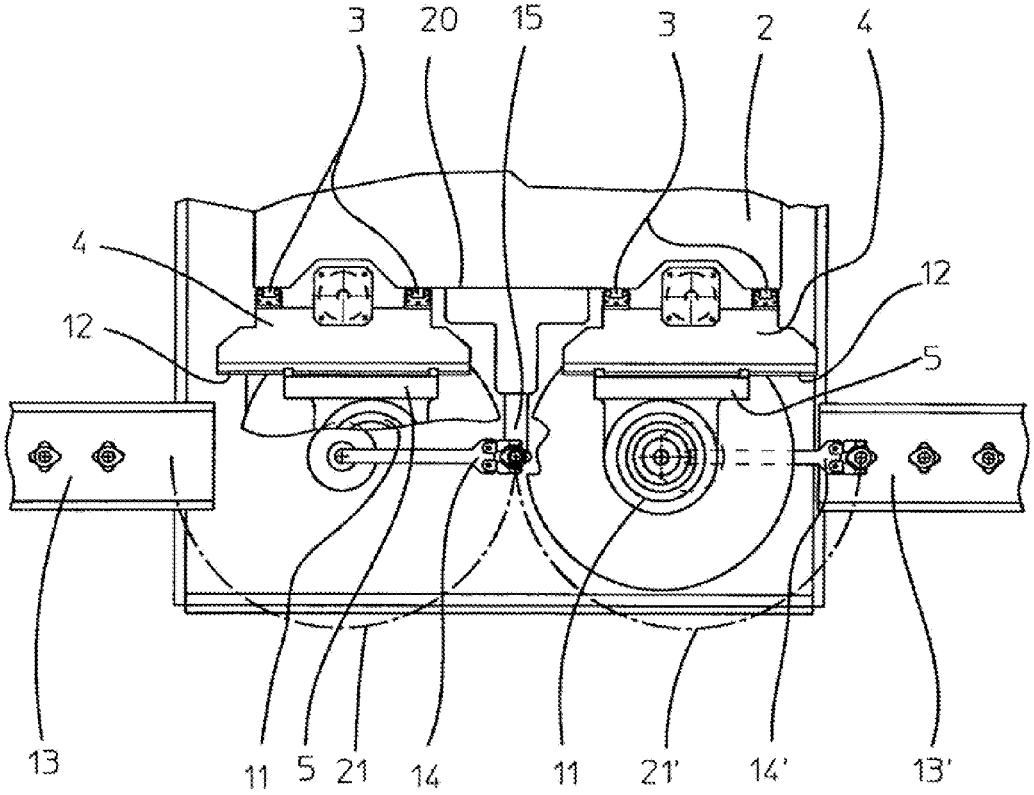
Figure 5:
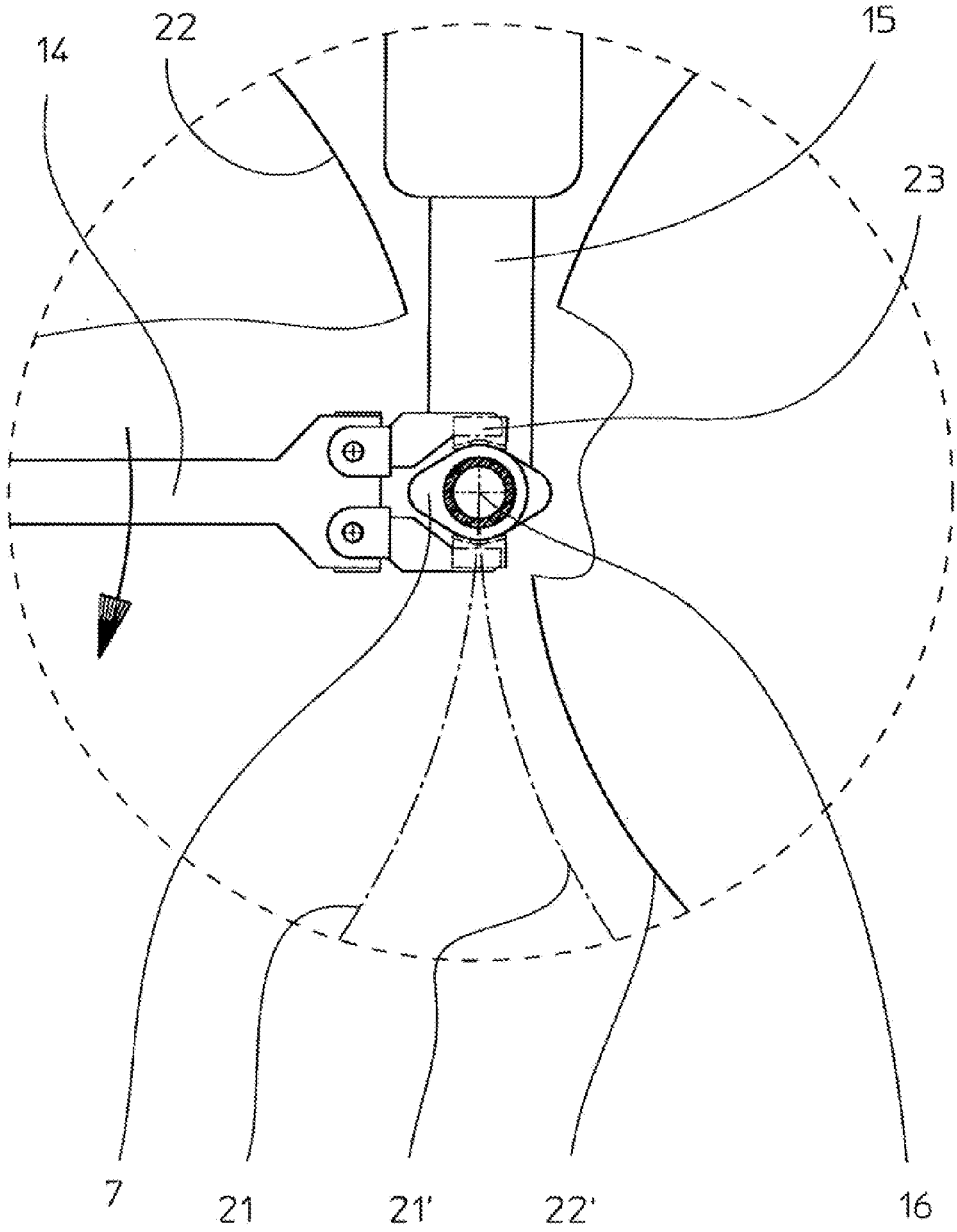
FIG. 5 shows a detail from FIG. 4 in enlarged scale.

In FIGS. 3 and 4 views of the loading process are shown. FIG. 3 shows the workpiece grabs 14 and 14' during a pivoting movement. The workpiece grabs 19 and 19' are pivotal arms. With them, the camshafts 7 are moved for loading and unloading between the conveyors 13 and 13' and the workpiece holder 6 on respective circularly arcuate paths 21 and 21'. According to FIG. 4, an unmachined camshaft is inserted into the workpiece holder 6 while at the same time a completely machined camshaft 7 is deposited onto the output conveyor 13'. To show the details in the area of the workpiece rotation axis 16, in FIG. 5, grinding wheels 22 and 22' are shown partially broken away. For holding the camshafts 7, the workpiece grab 14 is provided with a two-arm gripper 23.

When the gripper is open, the workpiece grab 14 can swing along the respective arcuate path 21 into or out of alignment with the workpiece rotation axis 16 for gripping or releasing a camshaft 7.

Figure 6:
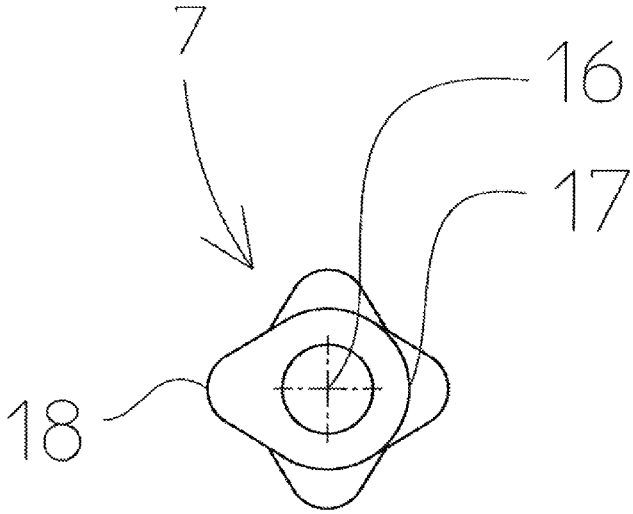
FIG. 6 shows a camshaft in an end view.

FIG. 6 shows details of the camshaft 7 with the workpiece rotation axis 16 in an end view. Each cam has a basic circular shape 17, beyond which the cam lobe 18 projects. In the camshafts for four cylinder combustion engines, the cam lobes 18 are located relative to the workpiece rotation axis 16 in mirror image, offset by angles of 90° degrees.

The invention claimed is:

1. A method of grinding of cams of a camshaft in a clamp with two grinders, wherein the camshaft has at least two cams or pairs of cams, the cams or cam pairs each have a basic circular shape and a cam lobe, the cams or cam pairs are located diametrally oppositely to each other relative to the workpiece rotation axis, the camshaft is clamped into a workpiece holder and is rotated around its longitudinal axis, the method comprising the following steps:

a) automatic clamping of the camshaft into the workpiece holder;

b) simultaneously machining two diametrally opposite cams or cam pairs by grinders;

c) moving the grinders relative to the camshaft parallel to the workpiece rotation axis to alignment with unmachined cams or pairs of cams;

d) repeating step b);

e) if needed repeating steps c) and b) until all cams or pairs of cams are machined;

f) automatically unloading the camshaft; and g) determining a desired feed speed from a speed profile associated with the basic circular shape and the cam lobes for the rotation of the camshaft, and, for grinding, rotating diametrally opposite cams of the camshaft in accordance with their speed profile.

2. The method according to claim 1 wherein during loading and unloading the camshaft is moved transversely of the workpiece rotation axis.

3. A method of grinding of cams of a camshaft in a clamp with two grinders, wherein the camshaft has at least two cams or pairs of cams, the cams or cam pairs each have a basic circular shape and a cam lobe, the cams or cam pairs are located diametrally oppositely to each other relative to the workpiece rotation axis, the camshaft is clamped into a workpiece holder and is rotated around its longitudinal axis, the method comprising the following steps:

a) automatic clamping of the camshaft into the workpiece holder;

b) simultaneously machining two diametrally opposite cams or cam pairs by grinders;

c) moving the grinders relative to the camshaft parallel to the workpiece rotation axis to alignment with unmachined cams or pairs of cams;

d) repeating step b);

e) if needed repeating steps c) and b) until all cams or pairs of cams are machined;

f) automatically unloading the camshaft by a first workpiece grab from the workpiece holder and simultaneously inserting an unmachined camshaft into the workpiece holder by a second workpiece grab.

4. A method of grinding an unmachined camshaft extending along a camshaft axis and having a plurality of pairs of cams with the cams of each pair having diametrally oppositely projecting lobes, the method comprising the steps of sequentially:

a) loading the unmachined camshaft into a holder of a camshaft-grinding machine by positioning the unmachined camshaft generally parallel to but offset from a rotation axis of the holder, engaging an input grab with the positioned unmachined camshaft and swinging the unmachined camshaft through an arc to a position with the axis of the unmachined camshaft aligned with the rotation axis of the holder, and chucking the unmachined camshaft in the holder;

b) rotating the unmachined camshaft with the holder about the camshaft axis;

c) simultaneously engaging each of two grinders diametrally radially inwardly against respective cams of the rotating camshaft to machine the cams engaged by the grinders;

d) disengaging the grinders from the respective cams when same are fully machined and shifting the disengaged grinders axially of the camshaft into radial alignment with two other cams and then repeating step c) with the two other cams until same are also fully machined;

d) disengaging the grinders from the other cams of the camshaft with the fully machined cams;

e) unloading the camshaft with the fully machined cams from the holder.

5. The method defined in claim 4, further comprising the step of:

varying the rotation rate of the camshaft during each single revolution such that the grinders and cams move at different relative speeds depending on where they engage one another.

6. The method defined in claim 4 wherein the machined camshaft is unloaded from the holder by sequentially:

arresting rotation of the holder engaging an output grab with the machined camshaft in the holder;

dechucking the machined camshaft from the holder; and swinging the machined camshaft through an arc to a position with the axis of the machined camshaft offset from a rotation axis of the holder.

7. The method defined in claim 4 wherein the unmachined camshaft is loaded into the holder by the substeps of:

positioning the unmachined camshaft with the camshaft axis generally parallel to but offset from a rotation axis of the holder at an input location;

engaging an input grab with the positioned unmachined camshaft and swinging the unmachined camshaft through an arc to a position with the axis of the unmachined camshaft aligned with the rotation axis of the holder;

chucking the unmachined camshaft in the holder, the machined camshaft being unloaded from the holder by sequentially:

arresting rotation of the holder engaging an output grab with the machined camshaft in the holder;

dechucking the machined camshaft from the holder; and swinging the machined camshaft through an arc to an output position with the axis of the machined camshaft offset from a rotation axis of the holder and diametrally opposite the input location.

8. A machine for grinding an unmachined camshaft extending along a camshaft axis and having a plurality of pairs of cams with the cams of each pair having diametrally oppositely projecting lobes, the machine comprising:

a frame;

a holder on the frame and defining a workpiece rotation axis generally fixed relative to the frame;

means for loading the unmachined camshaft into the holder with the camshaft and rotation axes substantially coaxial;

drive means for rotating the unmachined camshaft in the holder about the workpiece rotation axis;

a pair of grinders axially and radially shiftable on the frame relative to the workpiece rotation axis and having respective grinding tools rotatable about respective axes substantially parallel to, diametrally flanking, and coplanar with the workpiece rotation axis;

control means connected to the grinders for a) simultaneously engaging each of the grinding tools diametrally radially inwardly against respective cams of the rotating camshaft to machine the cams engaged by the grinding tools, b) disengaging the grinding tools from the respective cams when same are fully machined and shifting the disengaged grinders axially of the camshaft into radial alignment of the respective tools with two other cams and then repeating step c) with the two other cams until same are also fully machined, and c) disengaging the grinder tools from the other cams of the camshaft with the fully machined cams;

means for unloading the camshaft with the fully machined cams from the holder.

9. The grinding machine defined in claim 8, further comprising:

a steady rest mounted on the machine frame and engageable with the camshaft in the holder between the cams thereof.

10. The grinding machine defined in claim 9 wherein the frame has one wall on which the steady rest and the holder are both mounted.

11. The grinding machine defined in claim 8 wherein the loading means includes:

input conveyor means for positioning the unmachined camshaft at an input position with the camshaft axis substantially parallel to but offset from the workpiece rotation axis;

an input arm pivotal on the frame about an input-arm arm axis substantially parallel to the workpiece rotation axis; and an input grab on an outer end of the input arm shiftable on pivoting of the arm between the input position and the workpiece rotation axis.

12. The grinding machine defined in claim 11 wherein the unloading means includes:

an output conveyor defining an output position offset from the workpiece rotation axis, the input and output positions diametrally flanking the workpiece rotation axis;

an output arm pivotal on the frame about an output-arm axis substantially parallel to the workpiece rotation axis; and an output grab on an outer end of the output arm shiftable on pivoting of the output arm between the workpiece rotation axis and the output position.

13. The grinding machine defined in claim 12 wherein the input-arm axis and the output-arm axis diametrally flank the workpiece rotation axis.

14. The grinding machine defined in claim 13 wherein the input-arm axis, the output-arm axis, the workpiece rotation axis, the input position, and the output position all lie substantially in a common plane.

15. The grinding machine defined in claim 14 wherein the plane is vertical and the machine has a wall extending parallel to the plane and carrying both grinders.

* * * * *